United States Patent [19]

Venere et al.

[11] 4,269,002

[45] May 26, 1981

[54] METHOD FOR RESURFACING DISC BRAKE ROTORS

[75] Inventors: Lawrence A. Venere, Wood Dale; E. A. Domes, Carpentersville, both of Ill.

[73] Assignee: International Harvester Company, Chicago, Ill.

[21] Appl. No.: 45,511

[22] Filed: Jun. 4, 1979

[51] Int. Cl.[3] ..... B24B 1/00; B24B 23/02

[52] U.S. Cl. ..... 51/281 SF; 51/241 S; 51/DIG. 3

[58] Field of Search ..... 51/241 S, 250, 161, 51/281 SF, DIG. 3

[56] References Cited

U.S. PATENT DOCUMENTS

| | | | |
|---|---|---|---|
| 3,521,411 | 7/1970 | Henning | 51/281 SF |
| 4,086,732 | 5/1978 | Ramsey | 51/241 S |

*Primary Examiner*—Gary L. Smith

*Attorney, Agent, or Firm*—Douglas W. Rudy; Ronald C. Kamp; F. David AuBuchon

[57] ABSTRACT

Disc brake rotors on driven axles are resurfaced without being removed from host axles by replacing the relatively non-abrasive service brake pads with abrasive grinding pads. Grinding pads are urged into contact with the rotor being resurfaced utilizing the service brake piston. The rotor to be resurfaced is driven by the vehicle drive train after the vehicle has been raised to prevent wheel contact with the ground.

4 Claims, 5 Drawing Figures

METHOD FOR RESURFACING DISC BRAKE ROTORS

BACKGROUND OF THE INVENTION

1. Field of the Invention

This invention has to do with the machining of disc brake rotors.

More particularly this invention sets forth a method of machining disc brake rotors of all-wheel drive off highway construction equipment without the need of disassembling the brake rotor from the vehicle. The service brake pads are replaced with resurfacing pads and the rotors are rotated by the vehicle drive train while the vehicle is raised off the ground.

2. DESCRIPTION OF THE PRIOR ART

In resurfacing the rotors of off highway vehicles, as well as other vehicles, it has always been necessary to remove the rotors from the vehicles and take them to a machining station where they would be machined or resurfaced on stationary equipment. This would entail jacking up the vehicle, removing the wheels, removing the brake caliper assembly, removing the brake rotors, transporting the rotors to a machine shop, machining the rotors, and returning the rotors to the vehicle. The rotors would then be reinstalled, the brake calipers reinstalled, the wheels replaced and the machine lowered back to the ground. In all-wheel drive vehicles having planetary final drives, the amount of disassembly and reassembly is even more complex and time consuming.

In some applications, mostly heavy duty off road vehicles, this process is a very time consuming and costly process. Downtime for maintenance on off road vehicles is counter productive and inefficient hence to be minimized wherever possible.

Disc brake rotors of highway vehicles, such as passenger cars, are often integrally cast with the wheel bearing retainers. In these situations the resurfacing of the rotors also necessitates removal, cleaning, repacking and adjustments of the wheel bearings on the axles. Obviously these bearing related steps can be eliminated if the rotors don't have to be removed for resurfacing. Resurfacing in situ will save many steps in the resurfacing operation.

SUMMARY OF THE INVENTION

The method and apparatus disclosed in this specification has to do with a method of resurfacing disc brake rotors while they are mounted in their usual place on the host vehicle.

The steps involved in resurfacing the rotors are relatively few and quite simple. The operation is performed with the driven axles of the vehicle off the ground and the vehicle restrained so that the driving wheels can rotate freely while the host vehicle remains stationary. The frictional brake pads are removed and replaced with special abrasive pads designed to do the resurfacing. In some cases it may be necessary to remove drive wheels, consisting of tires and rims, to provide access to the disc brake calipers.

The wheel hosting the rotor to be resurfaced is then motored, utilizing the vehicle engine and drive train. Then the special abrasive pads are brought into contact using the service brake system of the vehicle, typically by applying force to the operator's brake control pedal. This provides the grinding pressure for resurfacing.

Other methods of performing the resurfacing operation will be disclosed further on in the detailed description of the invention.

The basic objective of this invention is to provide a method of resurfacing disc brake rotors without removing them from the host vehicle.

Also an object of this invention is to decrease the downtime normally required to resurface the brake rotor of a disc brake system.

Another object of this invention is to provide a method of resurfacing disc brake rotors without the removal of the brake calipers from their mountings.

A further object of this invention is to utilize the engine and drive train of a self-propelled vehicle to rotate a brake disc in a resurfacing operation.

Another object of this invention is to provide for increased brake rotor speed by locking one wheel of a pair of wheels on a single axle thus allowing differential action to increase the speed of the paired wheel.

Also an object of this invention is to provide an external source of brake application pressure, metered through a valve, to provide optimum grinding pressure.

Another basic object of this invention is to provide a brake pad having an abrasive surface for use in resurfacing disc brake rotors.

BRIEF DESCRIPTION OF THE DRAWING FIGS.

An embodiment of the instant invention is shown by the accompanying drawing FIGS. in which.

DETAILED DESCRIPTION OF THE INVENTION

Figure 1:
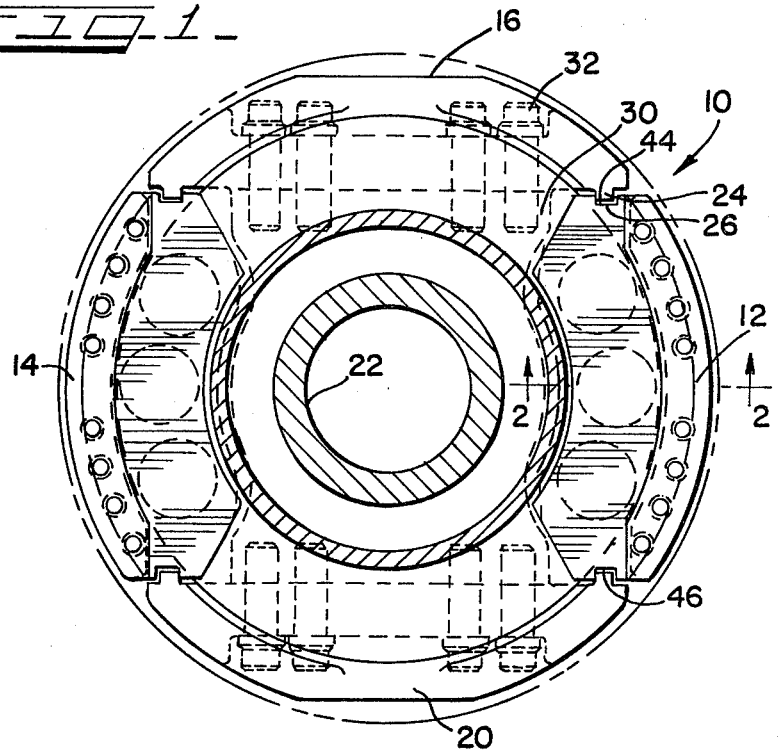
FIG. 1 is a partially sectioned elevation view of the end of a vehicle axle incorporating a pair of disc brake calipers.

A preferred embodiment of this invention is shown in the disc brake assembly depicted generally as 10 in FIG. 1. This FIG. shows the relationship between the brake calipers 12 and 14, the brake caliper and brake pad restraining torque bars 16 and 20 and a vehicle axle 22. The torque bars 16 and 20 are each provided with key guides 24 while the brake calipers are provided with keyways such as 26 that accommodate the key guides in a floating relationship such that the caliper is located appropriately but is free to float laterally. The torque bars, 16 and 20, are bolted to an axle housing 30 by bolts such as 32 so that they are stationary relative to the axle housing 30.

The disc brake pads are also provided with alignment grooves such as 44 and 46 (hidden by the calipers, but seen in FIG. 3) that loosely engage the torque bar key guides 24. The pads can float laterally until they contact the brake rotor or alternatively the caliper housing.

Figure 2:
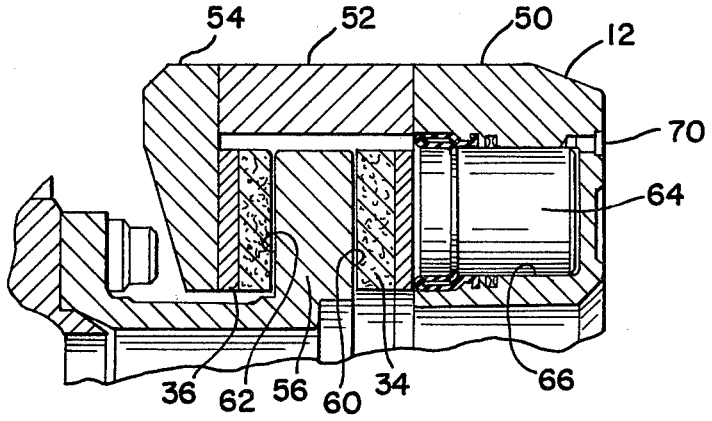
FIG. 2 is a partially sectioned cross sectional view of a disc and a disc brake caliper having special abrasive resurfacing pads installed.

FIG. 2 is a cross sectioned view of a disc brake caliper, the friction pads, the rotor and the rotating hub of a typical installation. The caliper proper is item 12 and includes an inboard piston housing 50, a rotor spanning spacer 52 and an outboard reaction member 54 which acts as the backstop retainer for an outboard friction pad 36. The inboard friction pad 34 is positioned on the inboard side of the rotor 56 adjacent the inboard surface 60 thereof. The outboard surface of the rotor is 62.

A brake piston 64 resides in a bore 66. The brake piston may be urged toward the brake rotor 56 when fluid pressure is supplied to port 70 thus applying braking pressure, via the pads 34 and 36, to the rotor 56 in a conventional manner.

Figure 3:
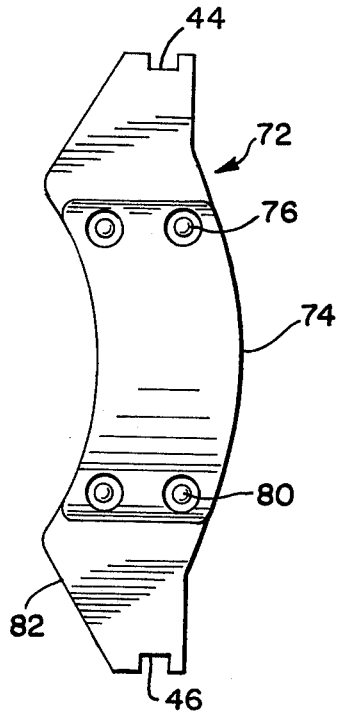
FIG. 3 is a plan view of a special abrasive resurfacing pad.
Figure 4:
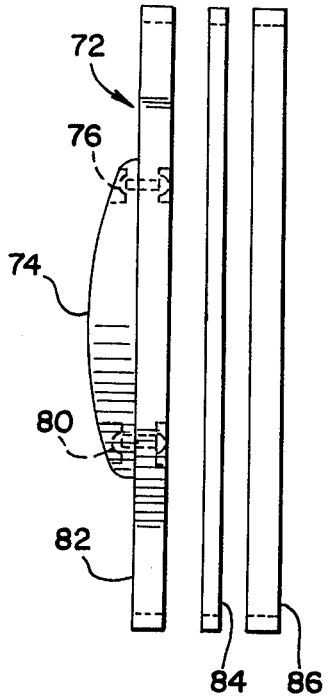
FIG. 4 is a side elevation view of a special abrasive resurfacing pad.

FIG. 3 and FIG. 4 represent a typical special abrasive pad generally 72. The configuration shown represents a pad that could be used in the FIG. 1 and FIG. 2 disc brake system. The abrasive pad 74 is riveted by rivets such as 76 and 80, to a steel backing plate 82 which is designed to fit into the brake caliper in place of the service brake pads.

The abrasive pads 74 could be attached to the steel backing plates by other alternative attachment methods such as bonding, glueing, screwing or bolting.

The abrasive material used in the pad could be any suitable grinding compound, for example silicon carbide could be used as the abrasive material.

In some situations it may be desirable to utilize a shim 84 or a spacer 86, or various combinations thereof, to appropriately position the special abrasive pad in the calipers.

Figure 5:
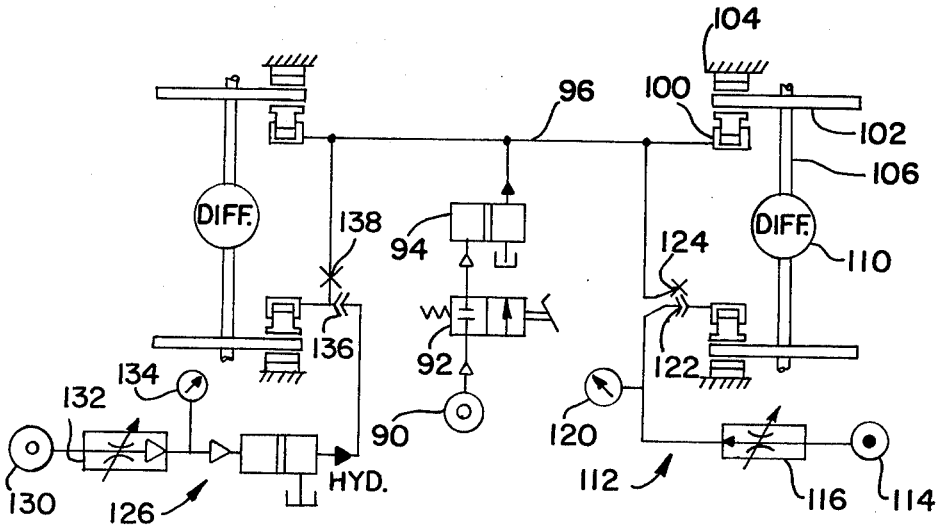
FIG. 5 is a schematic representation of an auxiliary pressure source and control valve used to modulate grinding pressure during resurfacing operations.

FIG. 5 presents a symplified braking system as may be incorporated in a four wheel drive vehicle. A pair of auxiliary pressure sources for use in applying the brake calipers when turning the brake discs are also shown. The on board braking system includes a source of pneumatic pressure 90 which supplies air under pressure to a master brake cylinder 92 which is pedal operated to stop the vehicle. When the master brake cylinder is open it will allow pressurized fluid to the air-over-hydraulic interface device 94 which will then transmit pressure through the hydraulic fluid medium contained in delivery lines such as 96 to disc brake calipers such as 100. The disc brake caliper 100 forces a friction pad against the disc brake rotor 102 at each wheel to stop the vehicle. Application force of the caliper 100 is resisted by the backing pad 104 which may be integral with the caliper as is shown by items 50,52 and 54 in FIG. 2. Each rotor is affixed to an axle such as 106 that may be driven by the usual vehicle driven train (not shown).

FIG. 5 shows a first auxiliary pressure source generally 112, which would typically include a hydraulic fluid source 114, a metering valve 116, a gauge to monitor line pressure 120 and a fitting 122 compatible with a fitting at the brake caliper to permit connection thereto. The service line would be blocked by fitting 124 when the first auxiliary pressure source 112 is connected to the brake caliper related to the rotor that is being resurfaced.

FIG. 5 also shows a second auxiliary pressure source, generally 126, which includes a pneumatic fluid source 130, a metering valve 132, a gauge 134 to monitor line pressure and a fitting 136 compatible with a fitting at the brake caliper to permit connection thereto. In this example the service line would be blocked by fitting 138 when the second auxiliary pressure source 126 is connected.

Either the first or the second auxiliary pressure source could be used instead of the service brake source depending on the type of fluid available to the mechanic. The practicality of working with shop air rather than hydraulic fluid may make the second auxiliary pressure supply preferential.

The auxiliary pressure supplies would be moved to the other rotor and caliper locations as necessary to perform the resurfacing operation on the other rotor locations.

The actual method of resurfacing the brake rotor is contemplated to encompass the following procedure:

(1) The vehicle is located in a convenient work area suitable for the performance of the resurfacing operation. A generally flat work station is preferred.

(2) The vehicle is jacked up and supported so that all the driven wheels are off the ground and free to rotate at speed without moving the vehicle being worked on. The vehicle is suitable restrained to prevent movement.

(3) Parts are removed as necessary to provide access to the brake calipers. In the large off highway vehicle for which this invention was first developed this would include the removal of the tires and rims.

(4) In the embodiment shown by FIG. 1 the upper torque bar 16 on each driven wheel is removed and the service brake pads are removed. On other embodiments in the extensive disc brake art other methods of removing the service brake pads are utilized. Such other methods are contemplated by this specification. The goal is to remove the service brake pads by whatever method is customary for that design of disc brake caliper.

(5) Install the special abrasive pads. It is preferred that the special abrasive pads are in light contact with the inboard and outboard surfaces of the rotor at this point hence it may be necessary to provide spacers or shims between the back sides of the special abrasive pads and the calipers to prevent excessive brake piston displacement.

(6) A preferred method of urging the special abrasive pads into working contact with the surfaces of the rotor is to disconnect and plug the vehicle fluid supply line that normally provides fluid under pressure for braking (at 70 in FIG. 2 and at 124/122 or 136/138 of FIG. 5) and attaching this actuator or caliper to one of the auxiliary sources of fluid pressure such as shop air 130 or a portable pressurized hydraulic fluid supply tank. Only one wheel would be disconnected from the vehicle fluid supply at a time. In the embodiment shown in FIG. 1 both calipers would be disconnected from the vehicle braking fluid supply even if only one caliper was being used to do the grinding. The auxiliary souce of fluid pressure would be supplied through a control valve 116 so that the degree of force exerted by the special abrasive pads against the rotor could be modulated to provide optimium grinding.

(7) Start the host vehicle engine and engage an appropriate gear such that the driven wheels of the vehicle are turning.

(8) Gradually adjust the control valve on the auxiliary source of fluid pressure such that proper machining of the rotor is accomplished.

(9) Where increased rotor speed is necessary and if the host vehicle is provided with a differential between various driven wheels, the service brakes may be applied thus increasing the speed of the rotor being resurfaced. The service brake will not lock up the rotor being resurfaced as that rotor caliper is being controlled by the control valve of the auxiliary souce of fluid pressure.

In a preferred embodiment of this invention it was found that with the host vehicle engine turning at 2100 RPM and the vehicle in 6th gear the rotor will be turning at 835 surface feet per minute. If the service brakes are then applied the rotor will speed up to about 3,340 surface feet per minute due to the actions of the inter-axle and drive axle differentials.

The steps detailing a resurfacing operation of a preferred embodiment as above may be varied in numerous permutations to fit other applications. This specification is drafted, and the inventors contemplate, the inclusion of various other plans of brake rotor resurfacing that are within the general scope of this disclosure.

It would be very possible, for instance to preclude the use of the auxiliary fluid supply and its control valve and just rely on modulated and gradual pressure on the vehicles normal brake pedal to urge special abrasive pads into contact with the rotors. Each caliper would have to be provided with a pair of pads.

Also in a situation where the auxiliary source is not used, putting special abrasive pads on only one wheel at a time may be possible. Quite possibly the normal brake pads in the other wheels would lock up the wheels thus allowing the special abrasive pad to do the resurfacing operation. The problem is that the abrasive pad may lock up the rotor being resurfaced while the other wheels, having normal service brakes, will run due to the relative coefficients of friction between the service brake pads and the special abrasive pads. Size and area variables may allow this type of operation.

An alternative to using the vehicle engine to drive the rotors to be resurfaced would be the use of an auxiliary rotating motor. This would be coupled to the rotor to be resurfaced either directly, for instance on the axle centerline or on the perimeter of the rotor if possible, or indirectly for instance through contact with a mounted wheel.

This type of rotor rotation would be necessary for rotating rotors on undriven wheels, typically the steering wheels on a two wheel drive vehicle.

Thus it is apparent that there has been provided, in accordance with this invention a method of resurfacing disc brake rotors while they remain installed in the host vehicle that fully satisfies the objects set forth above. Several embodiment variations have been described and it is apparent that other alternatives, modifications and variations will be apparent to those skilled in the art in light of the foregoing description. Accordingly, this disclosure is intended to embrace all such alternatives, modifications and variations as fall within the spirit and broad scope of the appended claims.

What is claimed is:

1. In a self propelled vehicle supported on driven wheels driven through a drive train including an engine, a gear equipped transmission and a differential equipped axle, said vehicle having a service brake system including a disc brake rotor mounted for rotational movement on said axle and a disc brake caliper having service brake pads carried thereby adjacent said disc brake rotor and a fluid pressure supply line connected to said disc brake caliper, a method of resurfacing said disc brake rotor while installed in said vehicle comprising the steps of removing said service brake pads from said disc brake caliper, installing special abrasive pads in said disc brake caliper, rotating said disc brake rotor after raising said driven wheels of said vehicle off the ground and engaging said gear of said transmission while said vehicle engine drive said differential equipped axle to which the disc brake rotor to be resurfaced is attached, the improved method of urging said special abrasive pads into contact with said disc brake rotor comprises:

disconnecting the fluid pressure supply line to the disc brake caliper of the rotor to be resurfaced;

capping said supply line to prevent leakage of fluid under pressure;

connecting an auxiliary source of fluid pressure, including a metering valve means, to the disc brake caliper of the rotor to be turned;

allowing metered flow from said auxiliary source of fluid pressure to said disc brake caliper to urge said special abrasive pads into contact with said disc brake rotor.

2. The invention in accordance with claim 1 further comprising:

applying the service brakes of the host vehicle thereby causing increased rotational speed of the disc to be surfaced due to differential action of said differential equipped axle.

3. In a vehicle supported on driven wheels carried on a differential equipped axle driven by an engine through a gear equipped transmission, said vehicle having a service brake system including a disc brake rotor mounted for rotational movement on said axle and a disc brake caliper having service brake pads carried thereby adjacent said disc brake rotor and a fluid pressure supply line connected to said disc brake caliper, a method of resurfacing said disc brake rotor while installed on said vehicle which comprises the steps of:

raising said driven wheels of said vehicle off the ground;

removing said service brake pads from said disc brake calipers;

installing special abrasive pads in said disc brake caliper;

disconnecting said fluid pressure supply line to said disc brake caliper of the rotor to be turned;

capping said supply line to prevent leakage of fluid under pressure;

connecting an auxiliary source of fluid pressure, including a metering valve means, to the disc brake caliper of the rotor to be turned;

running the host vehicle engine;

engaging a selected gear in the vehicle transmission driving said differential equipped axle to which the disc brake rotor to be turned is attached;

applying the service brakes of the host vehicle;

allowing metered flow from said auxiliary source of fluid pressure to said disc brake caliper to urge said special abrasive pads into contact with said disc brake rotor.

4. The invention in accordance with claim 3 wherein said axle is a differential equipped axle and applying the service brakes of the host vehicle will lock up the service brakes while the rotor being resurfaced will speed up due to said differential equipped axle function.

* * * * *